US005803668A

United States Patent [19]

Seki et al.

[11] Patent Number: 5,803,668

[45] Date of Patent: Sep. 8, 1998

[54] METHOD OF CONSTRUCTING GRAVITY-TYPE MARINE STRUCTURE AND STRUCTURE BY SAME

[75] Inventors: Atushi Seki; Yoichi Nojiri; Kenji Yanagiya; Jiro Takase, all of Tokyo, Japan

[73] Assignee: Kajima Corporation, Tokyo, Japan

[21] Appl. No.: 663,275

[22] PCT Filed: Dec. 17, 1993

[86] PCT No.: PCT/JP93/01836

§ 371 Date: Sep. 3, 1996

§ 102(e) Date: Sep. 3, 1996

[87] PCT Pub. No.: WO95/16829

PCT Pub. Date: Jun. 22, 1995

[51] Int. Cl.[6] ..... E02B 17/00

[52] U.S. Cl. ..... 405/204; 405/195.1

[58] Field of Search ..... 405/204, 203, 405/205–208, 222, 223, 195.1

[56] References Cited

U.S. PATENT DOCUMENTS 4,094,162 6/1978 Allee ..... 405/204
4,187,038 2/1980 Taylor ..... 405/204

FOREIGN PATENT DOCUMENTS 1210952 10/1959 France ..... 405/204
2283047A 3/1976 France .
1509503 5/1978 United Kingdom ..... 405/204

*Primary Examiner*—Dennis L. Taylor
*Attorney, Agent, or Firm*—Muramatsu & Associates

[57] ABSTRACT

In case of constructing a gravity-type marine structure at a spot with a comparatively great depth of water, a footing 2 serving as a float is constructed in a dry dock, and a cylindrical body 4 constituting an underwater substructure is constructed on the footing 2 in a shallow sea yard. The cylindrical body 4 is telescopically assembled and an upper cylinder 4C is made to function as a float. Ballast water $W_b$ is filled in the footing 2 at the installing spot with a great depth of water to submerge the footing 2, and a lower cylinder is extended with the upper cylinder 4C as a float. After the footing 2 has landed, the footing 2 and the cylindrical body 4 are charged with a filler, and an upper structure on the sea is constructed on the upper part of the cylindrical body 4. Since the cylindrical underwater substructure is constructed in the telescopic form on the footing serving as the float, a structure adapted for a sea area with a great depth of water is constructed while the stability as the float is easily kept, even in an area incapable of ensuring a quiet coastal area with a great depth of water. In the installing spot with a great depth of water, the buoyancy and gravity are utilized to easily extend the structural body without any large-scale driving apparatus, and a huge structure is easily installed in a submerged state.

10 Claims, 9 Drawing Sheets

METHOD OF CONSTRUCTING GRAVITY-TYPE MARINE STRUCTURE AND STRUCTURE BY SAME

SPECIFICATION

1. Technical Field

This invention relates to a gravity-type marine structure construction method and a gravity-type marine structure applicable to a bent for a grand-scale sea bridge and a platform for petroleum or gas production or the like, which are installed in a sea area with a great depth of water.

2. Background Art

Recently, demand has increased for the construction of a marine structure installed in a sea area with a great depth of water. Structurally, the marine structures are roughly classified into a gravity type, a legged type and a floating type. Among these types, the gravity type or legged type is made the basis of a bent for a grand-scale sea bridge and a platform for petroleum or gas production, since such structures are needed to be rigidly fixed on the seabed.

The present invention is particularly concerned with a marine structure of the gravity type applied as the most suitable structural type to a case where a whole structural body requires high stiffness as one of required performance. In order to avoid a long-term construction on the sea in the installing spot because of risks, the gravity-type marine structure is usually constructed according to a quick construction method as follows. Namely, the major part of a structural body is constructed on land or on a quiet coastal area, then towed in fine weather to the installing spot, and then installed in a submerged state.

More specifically, according to the conventional construction method, the structural body is constructed in a dry dock as much as possible within the draft of the dry dock. The structural body thus constructed is caused to float and then towed out of the dock. Thereafter, in a quiet coastal area with a depth of water approximately equivalent to that of the installing spot, the remaining structural body is constructed in a floating state on the sea for a long time.

However, in the conventional construction method, when the installing spot has a great depth of water, a quiet coastal area adapted to construct the major part of the structural body needs the depth of water equivalent to that of the installing spot. Therefore, in the area satisfying these very rare natural conditions such as the northern Europe having fjord coasts, many satisfactory results have already been given in construction of a large-scale gravity-type marine structure. However, as for the other areas, it was impossible to find a sea area which has a great depth of water in a spot close to the coast and satisfies the quiet natural conditions including waves and tidal currents or the like so as to ensure a long-term construction.

Consequently, the conventional gravity-type marine structure cannot be adapted for a sea area with a great depth of water except for the specific area, resulting in the disadvantage of the conventional gravity-type marine structure.

In various types of structures, regardless of the marine structure, various methods have already been provided to construct a structural body in a required form by extending or contracting the structural body by a driving apparatus utilizing specific energy. However, when the above methods are applied to the construction of the marine structure for a sea area with a great depth of water, it is necessary for the marine structure to withstand severe natural conditions (heavy hydrostatic pressure, wave power, tidal power, ice pressure, wind pressure and seismic force or the like). Thus, incomparatibly greater scale and strength to the land structures are required for the marine structure in the sea area with a great depth of water.

Therefore, the structural body should be constructed on a huge scale in order to withstand such severe natural conditions. A considerable amount of energy is required for expanding or contracting such a huge structural body by a usually-used mechanical driving apparatus. Further, the size of the driving apparatus is increased. Thus, it is almost impossible at present to apply the already-provided methods to the construction of the marine structure for a sea area with a great depth of water.

The present invention has been made to solve the above-mentioned problems, and it is an object of the present invention to provide a gravity-type marine structure and a method of constructing same, which is constructed at an installing spot with a comparatively great depth of water even in an area incapable of ensuring a quiet coastal area with a great depth of water, and which easily enables the extension of a structural body for installation without using a driving apparatus requiring specific energy.

DISCLOSURE OF THE INVENTION

A construction method according to the present invention for installing a gravity-type marine structure in a sea area with a comparatively great depth of water comprises the steps of: constructing a hollow footing for the gravity-type marine structure in a dry dock; constructing a telescopic underwater substructure for the gravity-type marine structure on the footing in the dry dock or a sea yard in a shallow sea area to easily stabilize the footing as a floating body; towing the footing and the underwater substructure to an installing spot; filling ballast water in the footing, which is at a standstill in a floating state at the installing spot, to submerge the footing; thereby extending a lower part of the underwater substructure with an upper part thereof functioning as a float; and charging the footing or the underwater substructure with a filler at need after the footing has landed on the seabed.

A steel or concrete structure or a hybrid structure composed of steel and concrete is applied to a structural body of the footing and the underwater substructure or the like. The underwater substructure may be arranged singly or in plurality. Further, the underwater substructure is constructed in the sea yard in the shallow sea area, but it may be constructed in the dry dock.

In case of submerging the underwater substructure in an extended state, seawater flows in the lower part of the underwater substructure. However, in case of charging the underwater substructure with the filler, the charging may be carried out in the water. Otherwise, after the footing has landed on the seabed, seawater may be drained from the underwater substructure to charge the underwater substructure with the filler in the air.

The gravity-type marine structure according to the present invention relates to a gravity-type marine structure installed in a sea area with a comparatively great depth of water, and comprises a hollow footing capable of exerting buoyancy and also capable of being filled with ballast water to meet the stabilizing conditions as a floating body, and an underwater substructure constructed on the footing and composed of a plurality of cylindrical bodies assembled in a telescopic form to easily stabilize the footing as the floating body such that the cylindrical bodies other than the cylindrical body fixed to the footing are made telescopic relatively to the cylindrical body fixed to the footing, wherein the upper cylindrical body of the underwater substructure serves as a float capable of exerting buoyancy to meet the stabilizing conditions as the floating body.

The footing is reinforced with and divided into a plurality of parts through partitions composed of inner slabs and bulkheads or the like. Further, the footing is provided with a plurality of intake valves to take in ballast water.

The uppermost cylindrical body of the underwater substructure serves as a float, in which a bulkhead is provided in a middle part, a lower part is submerged and a float chamber is defined in an upper part.

A connection portion between the cylindrical bodies of the underwater substructure is provided with hooks brought into engagement with each other to prevent the cylindrical body from falling off in case of extending the cylindrical body.

The lower part of each cylindrical body of the underwater substructure is provided with a water through hole permitting the communication between the inside and the outside of each cylindrical body to make it possible to naturally flow seawater in each cylindrical body.

The footing is provided with a closable filler-charging inlet to make it possible to charge the footing with the filler. Further, the bulkhead of the uppermost cylindrical body of the underwater substructure is provided with a filler-charging shaft to make it possible to charge the filler on the sea.

Incidentally, when the underwater substructure is charged with the filler in the air, water cut-off packings are arranged between the hooks. In this case, after the underwater substructure has been extended, a temporary float is fixed to the upper cylindrical body. Subsequently, the cylindrical bodies are clamped together at the connection portion to cut off seawater, and the seawater is drained from the underwater substructure so as to charge the underwater substructure with the filler in the air.

In the constitution described above, in case of constructing the structural body, the footing functions as the float, and the underwater substructure assembled in the telescopic form is constructed on the footing. Therefore, the whole structural body is constructed in the dry dock or the sea yard in the shallow sea area, while easily stabilizing the footing as the floating body. As a result, it is possible to construct the gravity-type marine structure in the installing spot with a great depth of water, even in an area incapable of ensuring a quiet sea yard in a coastal area with a great depth of water.

The footing and underwater substructure thus constructed are towed with the footing functioning as the float to the installing spot with a great depth of water, and the ballast water is filled in the footing at the installing spot. Only by this process, the lower part of the underwater substructure is automatically extended with the upper part thereof functioning as the float, and the buoyancy and the gravity are utilized to easily obtain huge power required for submerging. After the footing has landed on the seabed, the footing and the underwater substructure are charged with the filler at need to ensure the stability and the strength of the structural body. Subsequently, the upper structure on the sea is constructed on the upper end of the uppermost cylindrical body of the underwater substructure to attain a complete marine structure.

BEST MODE FOR EMBODYING THE INVENTION

Hereinafter will be given of a description of an embodiment of the present invention with reference to the accompanying drawings. The illustrated embodiment relates to a gravity-type marine structure supposed to be applied to a bent for a grand-scale sea bridge.

Figure 1:
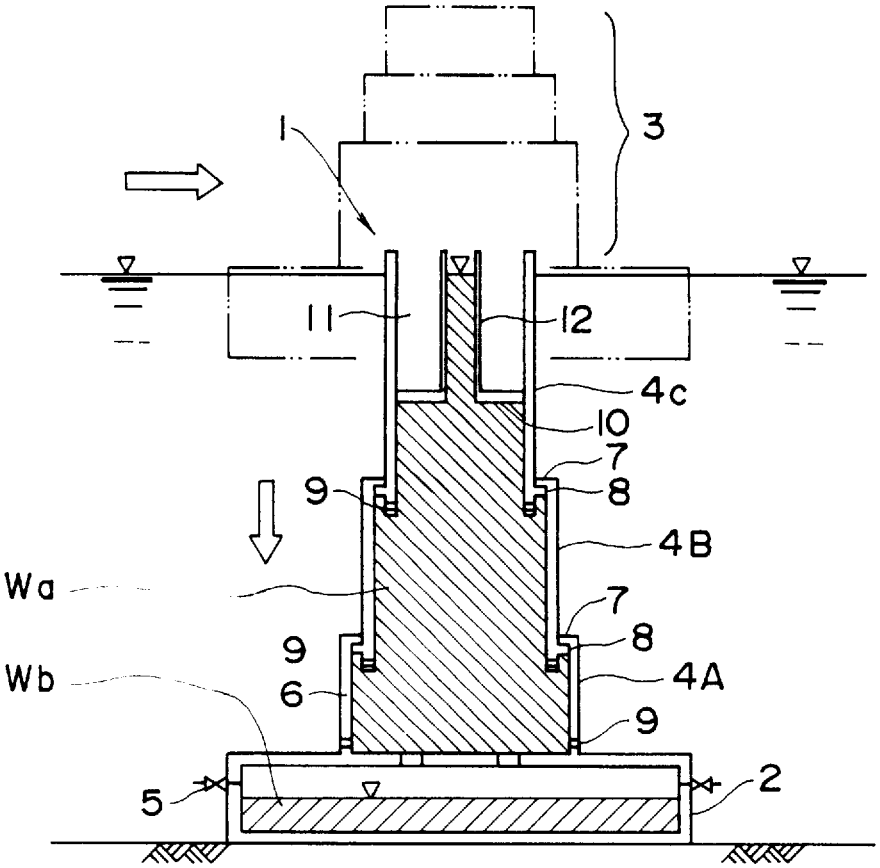
FIG. 1 is a schematic longitudinal sectional view showing a gravity-type marine structure as an embodiment of the present invention.

As shown in FIG. 1, a lower structural body of a gravity-type marine structure 1 comprises a hollow circular footing 2 functioning as a float and capable of being submerged by means of filling ballast water $W_b$, and an underwater substructure 3 constructed on the footing 2 and including a three-stage circular cylindrical body 4 composed of three cylinders assembled in a telescopic form to be made telescopic relatively to the footing 2.

Figure 2:
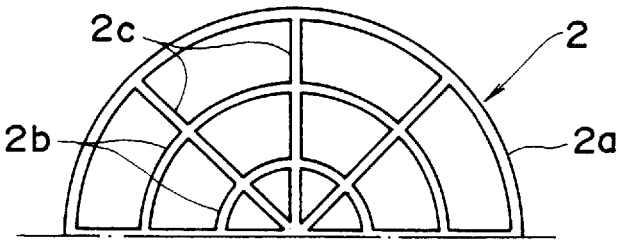
FIG. 2 is a schematic cross-sectional view showing the gravity-type marine structure shown in FIG. 1.

As shown in FIG. 2, the footing 2 is reinforced with and divided into a plurality of ballast chambers through, for instance, an outer slab 2*a*, inner slabs 2*b* concentric with the outer slab and radial bulkheads 2*c* which are all provided in the hollow inside of the footing. Further, as shown in FIG. 1, a remote-controlled closable intake valve 5 is provided to enable each ballast chamber to take in ballast water. In submerging, the intake valve 5 adjusts the intake of water to each ballast chamber of the footing 2 and controls so as to stably submerge the entire structural body while the relation between the center of buoyancy and the center of gravity of the entire structural body maintains the stability as a floating body. Further, the upper slab 2*a* included in the footing 2 to be located inside the cylindrical body 4 is provided with a remote-controlled closable inlet 6 to make it possible to charge the underwater substructure with a filler.

The cylindrical body 4 includes a lower cylinder 4A having the largest diameter, and an upper cylinder 4C designed to be the longest among the cylinders. The lower cylinder 4A is fixed to the footing 2, and a middle cylinder 4B and the lower cylinder 4C are made movable in the vertical direction with the outer cylinder as a guide. Further, wholly flange-like or partially-projected hooks 7 are provided on the inner surfaces of the upper ends of the lower cylinder 4A and the middle cylinder 4B to prevent the cylinders from falling out. Also, hooks 8 similar to the hooks 7 are provided on the outer surfaces of the lower ends of the middle cylinder 4B and the upper cylinder 4C and brought into engagement with the hooks 7 to prevent the cylinders from falling out.

Furthermore, water through holes 9 are provided in the lower ends of the cylinders 4A, 4B and 4C and equipped with water intake valves permitting the communication between the inside and the outside of the cylinders and capable of being opened or closed by the remote control. In this case, the intake valves are opened to make it possible to naturally flow seawater in the cylinders. The lower cylinder 4A and the middle cylinder 4B serve as chambers which are communicated with the seawater to exert no buoyancy. The upper cylinder 4A has a bulkhead 10 at the middle part, which divides the upper cylinder into a lower submerged part and an upper open float chamber 11. Therefore, the upper cylinder 4A is designed to serve also as a float exerting the buoyancy to meet the stabilizing conditions as a floating body.

The bulkhead 10 has an opening, and an upwardly erected shaft 11 for charging the filler is projected in the opening to make it possible to charge the footing 2 and the extended cylinders 4A, 4B and 4C with the filler on the sea. The filler-charging shaft 11 serves also as a shaft to transmit a vertical load at the completion at need.

In the constitution described above, the gravity-type marine structure is constructed as follows (See FIGS. 3 to 7)

Figure 3:
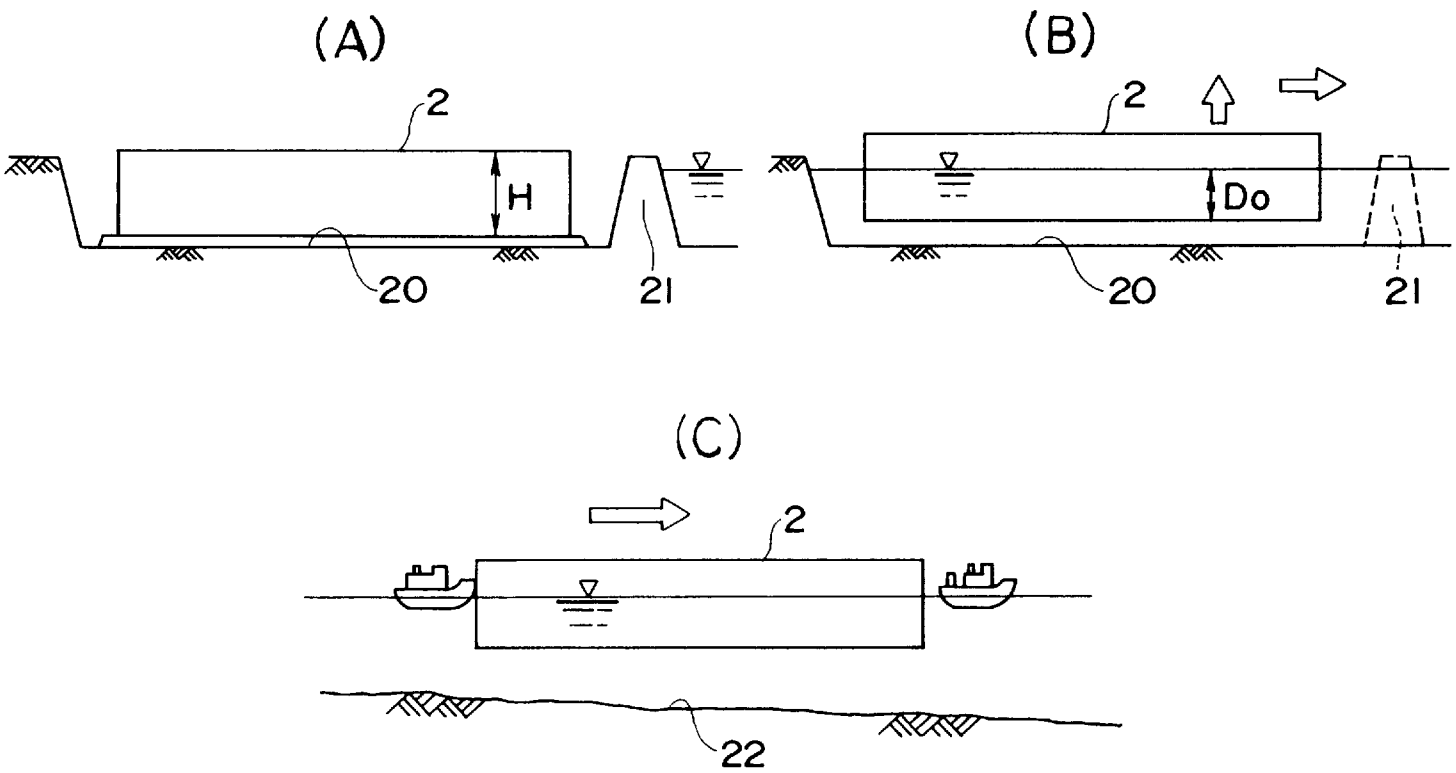
FIGS. 3 to 7 are schematic sectional views showing processes of a method of constructing a gravity-type marine structure according to the present invention in order, respectively.

(1) As shown in FIG. 3, a dry dock 20 having a depth enough to float and tow the footing in the next process is constructed in a land area close to sea, and the footing 2 is constructed in the dry dock 20. Further, skirts and dowels or the like are installed on the bottom of the footing 2 at this stage, if required in the landing on the seabed (or mound) at the installing spot as will be described later.

(2) After the completion of the footing 2, the dry dock 20 is filled with water to float the footing 2. Then, a gate 21 is opened to tow the footing 2 out of the dry dock 20. The footing 2 is hereat able to exert the buoyancy equivalent to the weight of the footing at the draft $D_0$. Therefore, the dry dock 20 may be designed to be deeper than the draft $D_0$.

(3) The footing 2 is towed to a sea yard 22 in the shallow sea area by a tugboat or the like.

Figure 4:
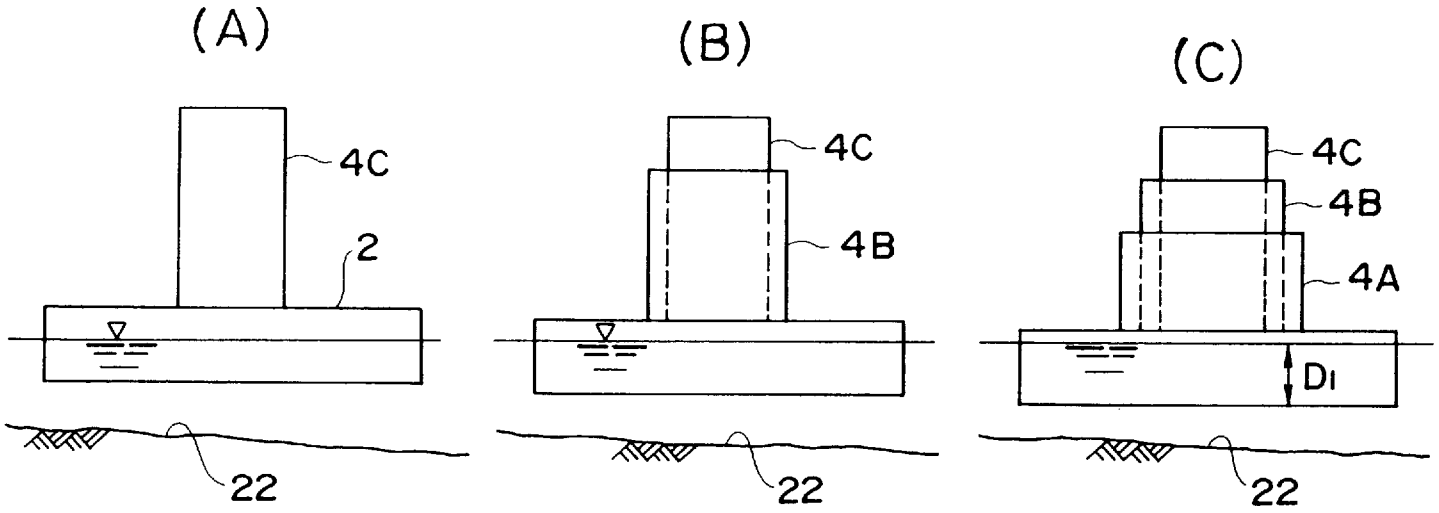

(4) As shown in FIG. 4, the footing 2 is firmly moored by anchors or the like in the sea yard 22 in the shallow sea area so as to withstand a long-term construction of the underwater substructure. Then, the inside upper cylinder 4A serving as a float to meet the stabilizing conditions as the floating body is constructed. Incidentally, it is necessary for the sea yard 22 in the shallow sea area to meet the quiet natural conditions including waves and tidal currents.

(5) The middle cylinder 4B is constructed to surround the upper cylinder 4C.

(6) The lower cylinder 4A is constructed to surround the middle cylinder 4B. The sea yard 22 in the shallow sea area may have a depth of water enough to cover the draft $D_1$.

Figure 5:
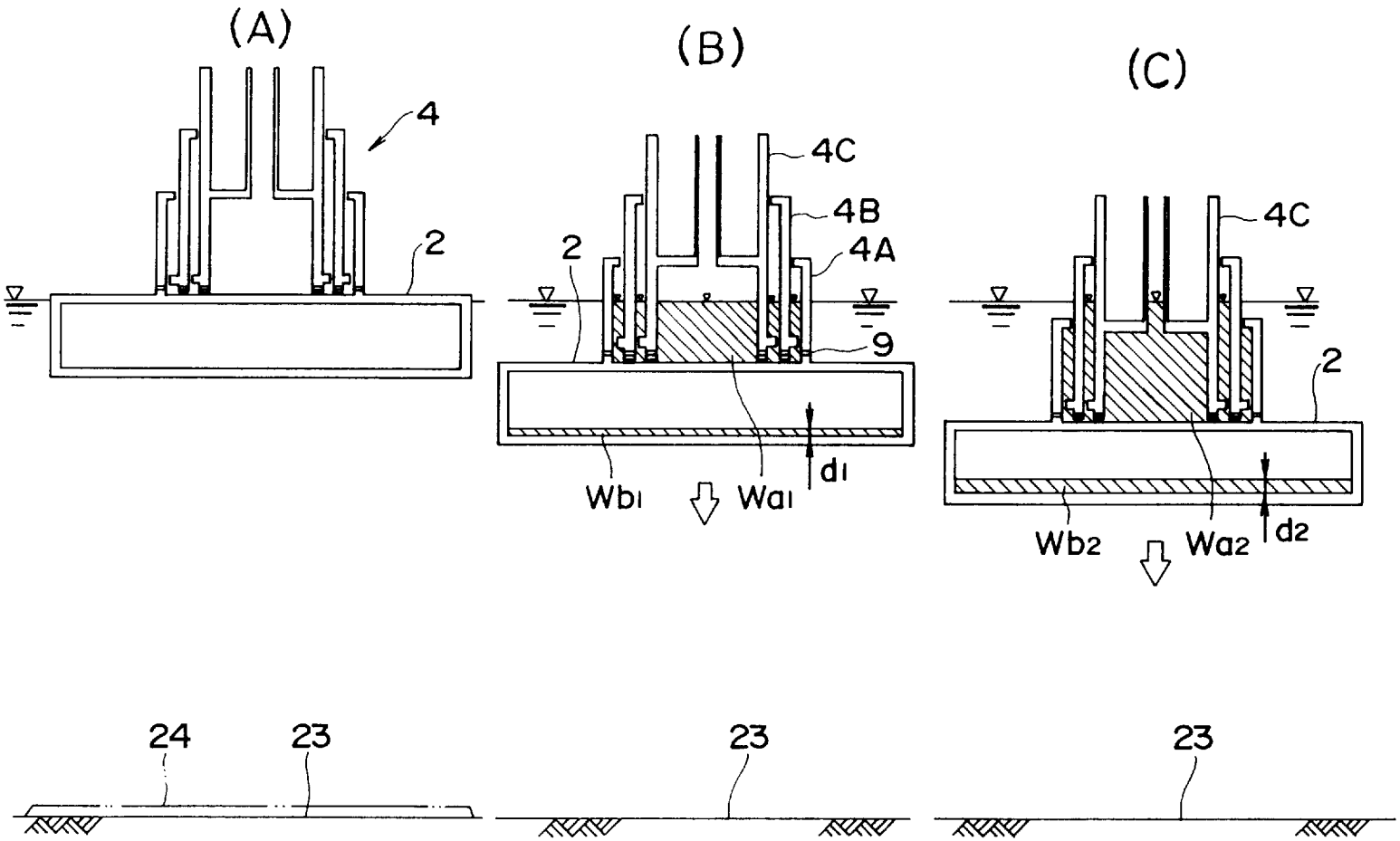

(7) As shown in FIG. 5, the footing 2 mounted with the completely constructed cylindrical body 4 is towed to the installing spot 23, and moored by anchors or the like on the seabed or a mound 24 preliminarily formed at need to rest the footing in a floating state.

(8) Ballast water $W_b$ is filled in the footing 2 to start submerging the footing slowly. Then, seawater naturally flows in the lower cylinder 4C, the middle cylinder 4B and the bottom of the upper cylinder 4A through the water through holes 9.

(9) Since seawater $W_a$ continues naturally flowing in the lower cylinder 4C, the middle cylinder 4B and the bottom of the upper cylinder 4A, the upper cylinder 4C gradually exerts buoyancy. In addition, ballast water $W_b$ sufficient to offset the buoyancy is kept flowing in the footing 2 to continue submerging.

Figure 6:
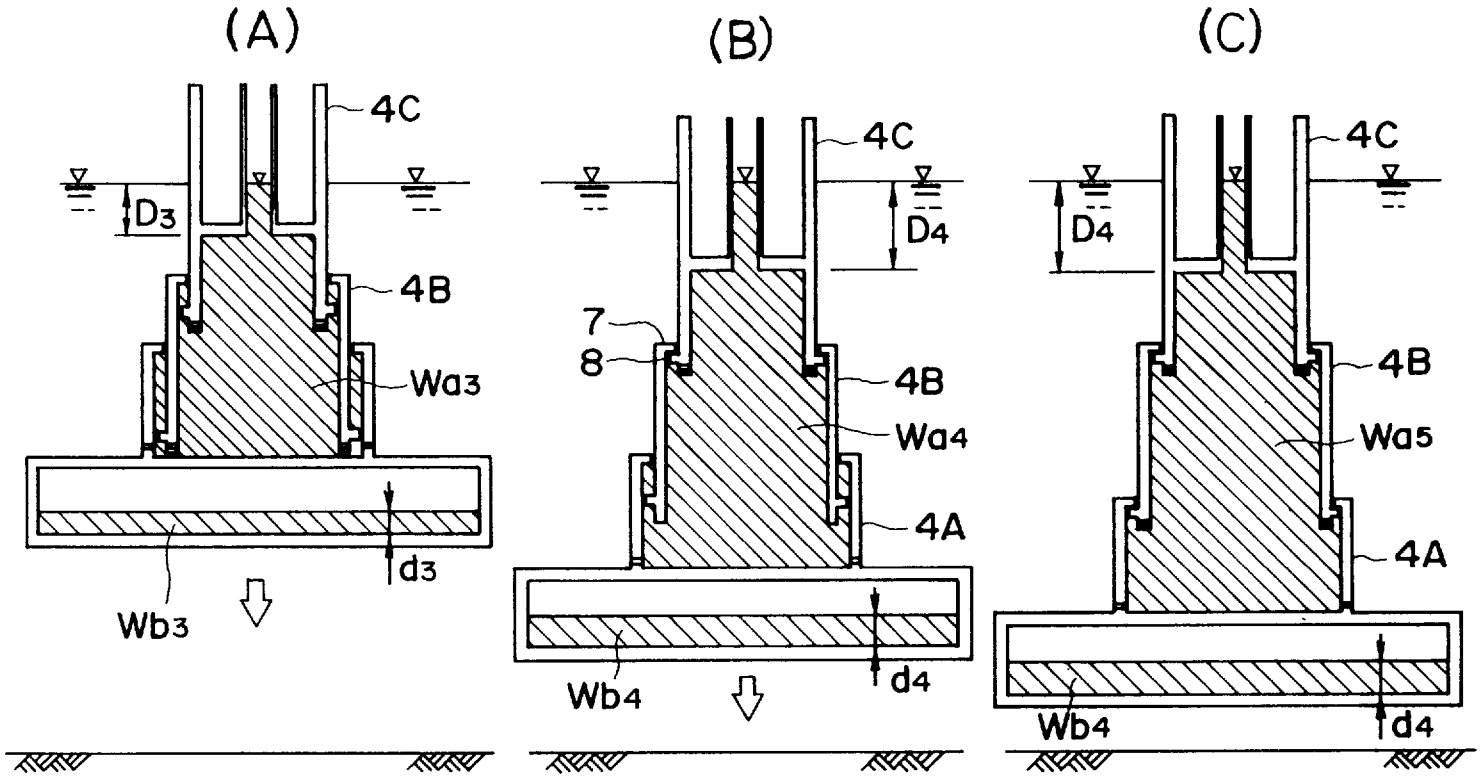

(10) As shown in FIG. 6, when the submerging advances so that the draft $D_3$ of the upper cylinder 4C reaches a predetermined depth, the upper cylinder 4C exerts the function as the float. The upper cylinder 4C itself meets the stabilizing condition as the floating body and enters the floating state. Since the middle cylinder and its lower part continue submerging, the middle cylinder 4B and its lower part are extended downward against the upper cylinder 4C. From a different point of view, the upper cylinder 4C is extended against the middle cylinder 4B.

(11) When the submerging further advances, the upper cylinder 4C and the middle cylinder 4B are brought into engagement with each other by the hooks 7, 8. Until the buoyancy exerted on the upper cylinder 4C becomes larger than the resultant weight of the upper cylinder 4C and the middle cylinder 4B, the submerging is continued with the entire body consolidated into a unit while maintaining the current state of the cylindrical body. When the submerging advances so that the draft $D_4$ of the upper cylinder 4A reaches a predetermined depth, the upper cylinder 4C starts hanging the middle cylinder 4B, and only the lower cylinder 4A and the footing 2 continue submerging. In this case, since the lower cylinder 4A and its lower part continue submerging, the lower cylinder 4A and its lower part are extended downward against the middle cylinder 4B. From a different point of view, the middle cylinder 4B is extended against the lower cylinder 4A.

(12) When the submerging further advances, each of the lower cylinder 4A, the middle cylinder 4B and the upper cylinder 4C is extended to its full length.

Figure 7:
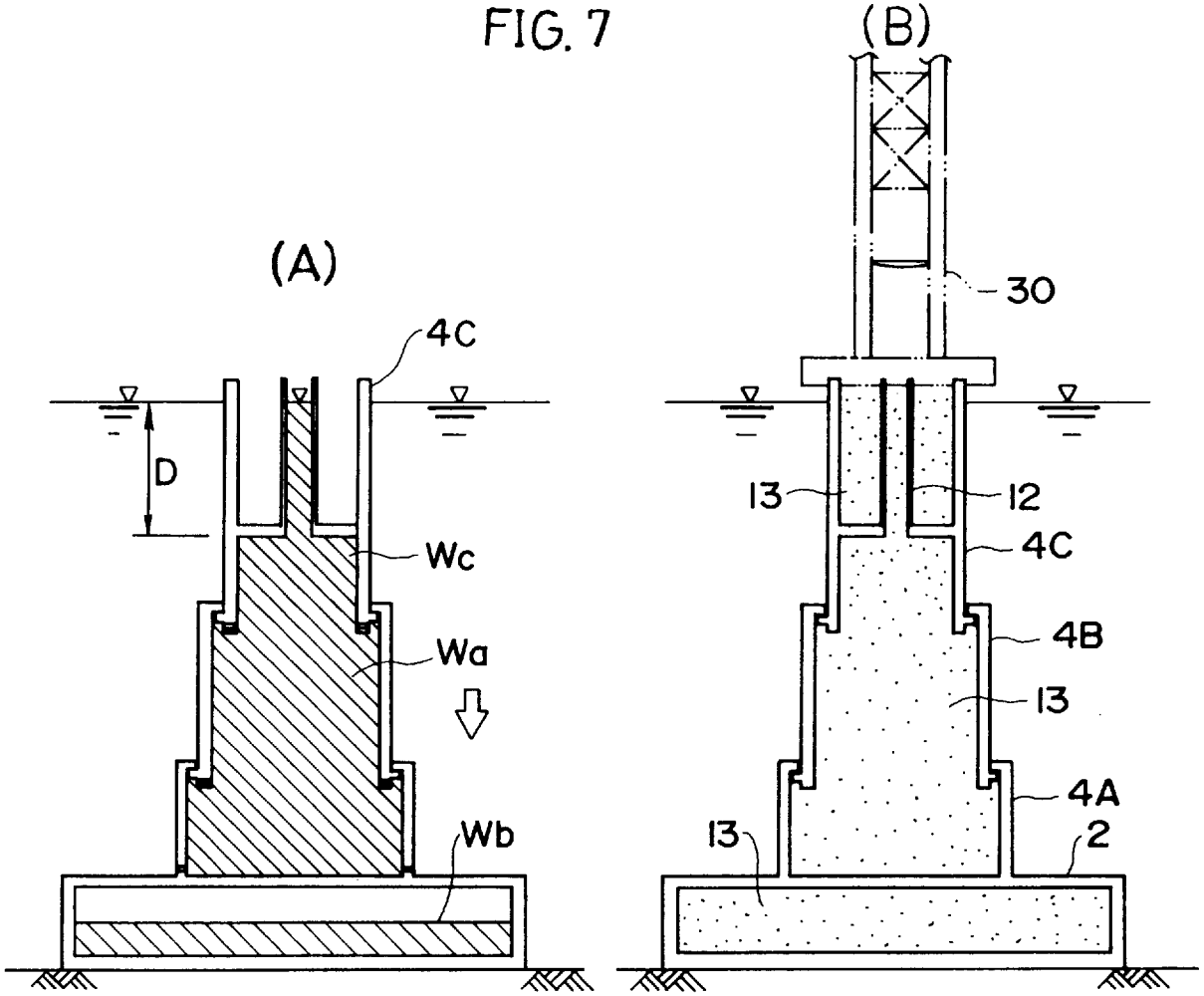

(13) As shown in FIG. 7, when each of the lower cylinder 4A, the middle cylinder 4B and the upper cylinder 4A is extended to its full length, the ballast water $W_b$ is gradually filled in the upper cylinder 4C to cause the footing 2 to land on the seabed with a predetermined depth of water. Thereafter, the ballast water $W_b$ is additionally filled in the footing 2 to stabilize the structural body. Incidentally, after the structural body has landed on the seabed, grouting or the like is executed between the seabed (or mound) and the footing at need to prevent an excessive local contact pressure from being applied. Further, the processes (7) to (13) are to be executed in fine weather.

(14) After the structural body has landed on the seabed, the filler 13 enough to satisfy the performance required at the completion is charged inside the footing and the required parts of the cylinders 4A, 4B through the inlet 6 and the shaft 12, and further charged inside the required part of the cylinder 4C to secure the stability and strength of the structural body required at the completion. Subsequently, an upper structure 30 on the sea is constructed to attain a complete marine structure.

Figure 8:
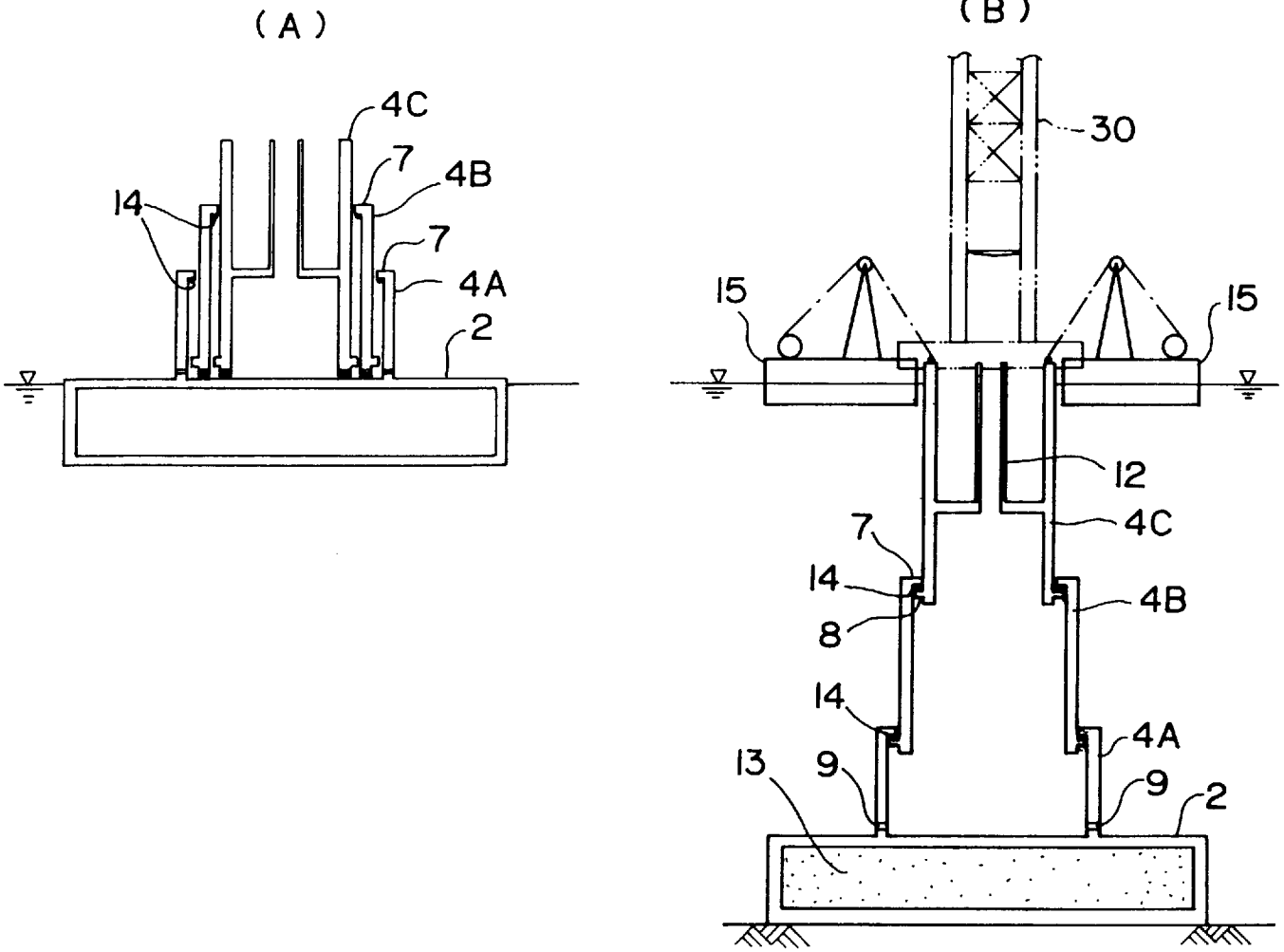
FIG. 8 is a schematic sectional view showing the filler-charging work carried out in the air according to the construction method.

The above embodiment is applied to a case where the structural body is charged with the filler in the water. However, the structural body may be charged with the filler in the air. In this case, as shown in FIG. 8(A), water cutoff packings 14 are attached, for instance, on the lower surfaces of the upper hooks 7 (wholly flange-like hooks) of the middle cylinder 4C and the lower cylinder 4A. Then, the water cutoff packings 14 are activated between the hooks 7, 8 to make it possible to maintain the airtightness in the foregoing process (14), as shown in FIG. 8(B).

In the construction in the air, the movement of each member in the processes (1) to (13) is similar to that in the underwater construction. However, the process (14) in the construction in the air is executed as follows (See FIG. 8(B)).

(14-1) After the structural body has landed on the seabed, the temporary float 15 is installed to the upper periphery of the upper cylinder 4A, and connected to the upper end of the upper cylinder 4A through, for instance, a wire rope or the like. This process is to supplement the buoyancy, since the buoyancy exerted on the upper cylinder 4A is lost when seawater is drained from the cylindrical body 4 in the subsequent process. Further, the buoyancy exerted by this temporary float 15 is set to be as large as the buoyancy which is enough to hold the upper cylinder 4A and the middle cylinder 4B and enables the water cutoff packings 14 to exert the water cutoff function.

(14-2) The footing is charged with the filler in a predetermined manner.

(14-3) The valve of the water through hole 9 in the lower part of the lower cylinder 4A is closed. Since the water through holes 9 of the other cylinders do not face the outside, these water through holes 9 are kept unchanged.

(14-4) The seawater is drained from the cylindrical body 4 by an appropriate means.

(14-5) The cylindrical body 4 is charged with the filler in the air. This charging work is carried out until the structural body of the cylindrical body portion including the connection parts between the cylinders satisfy the function required at the completion.

(14-6) Subsequently, the predetermined upper structure 30 is constructed for completion.

Figure 9:
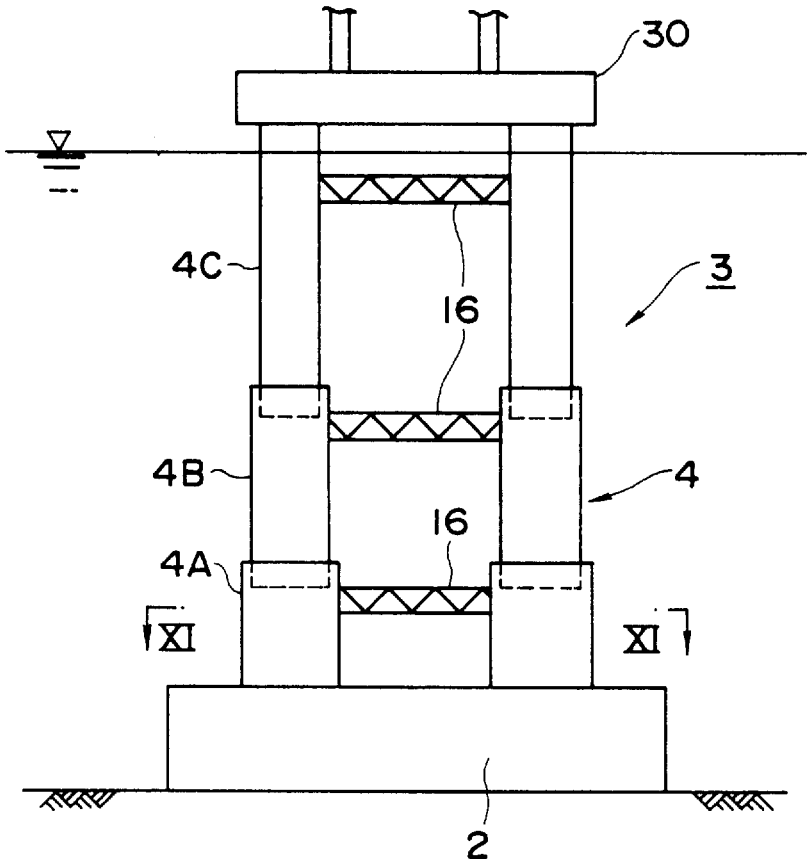
FIG. 9 is a front view showing a gravity-type marine structure as another embodiment of the present invention.
Figure 10:
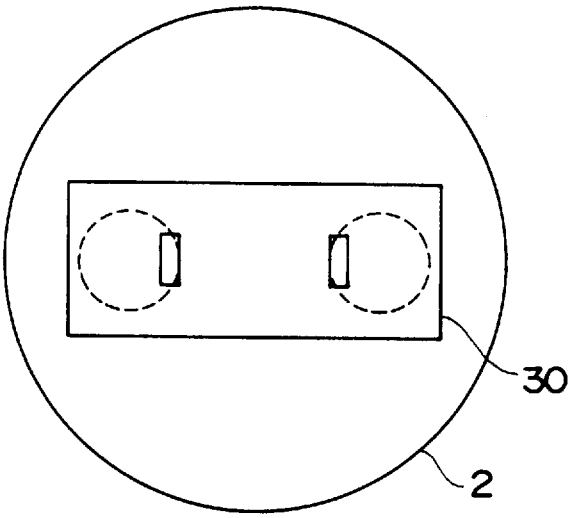
FIG. 10 is a plan view showing the gravity-type marine structure as another embodiment of the present invention.
Figure 11:
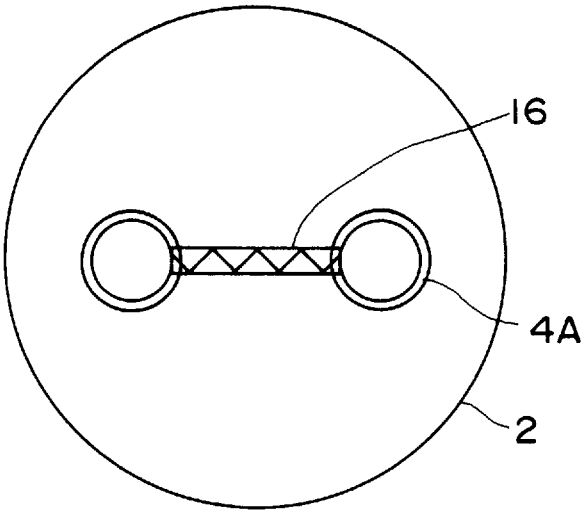
FIG. 11 is a sectional view showing the gravity-type marine structure as another embodiment of the present invention.

FIGS. 9 to 11 show a gravity-type marine structure as another embodiment of the present invention, respectively. According to this embodiment, a pair of underwater substructures 3 composed of the cylindrical bodies 4 are installed on the left and right sides of a circular footing 2 in plane. Then, the upper parts of each cylindrical body 4 are connected together by reinforcing members 16, and the upper ends of the pair of cylindrical bodies 4 are connected together by the upper structure 30 on the sea.

In the above embodiments, the planar shape of the footing 2 is circular. However, the footing 2 may take a rectangular, polygonal or any other desired shape. Further, the underwater substructure 3 may be arranged planarly on the footing singly or in plurality at will. Furthermore, the cylindrical body may take a circular, rectangular, polygonal or any other desired shape at will.

Moreover, it is possible to impose the float function on the middle cylinder 4B. The cylindrical body is extended in three stages in the above embodiment. However, a two-stage cylindrical body without the middle cylinder or a multi-stage cylindrical body in four or more stages falls within the true spirit and scope of the present construction method.

In the above embodiments, it is assumed that the construction method is applied to the bent for a grand-scale sea bridge. However, it is a matter of course that the present invention is applied to other large-scale gravity-type marine structures.

INDUSTRIAL APPLICABILITY

The construction method of the present invention comprises the steps of constructing a multi-stage cylindrical body, which constitutes the underwater substructure, on the footing serving also as a float in the sea yard in the shallow sea area, then submerging the footing at the installing spot with a great depth of water, thereby extending the lower cylinder with the upper cylinder functioning as the float, and then installing the footing in a landing state. Therefore, the present invention is applicable to the following.

(1) It is possible to construct a gravity-type marine structure adapted for a sea area with a great depth of water, even in an area incapable of ensuring a quiet coastal area with a depth of water equivalent to that of the installation spot with a great depth of water.

(2) It is possible to produce huge power to extend the structural body by utilizing the buoyancy by seawater and the gravity, and the huge gravity-type marine structure is easily installed even in a sea area with a great depth of water without using a large-scale driving apparatus.

We claim:

1. A method of constructing a gravity-type marine structure in case of installing the gravity-type marine structure in a sea area with a comparatively great depth of water, comprising the steps of:

constructing a hollow footing for the gravity-type marine structure in a dry dock, the footing exerting buoyance in water to function as a float and having an intake valve capable of taking in ballast water;

constructing a telescopic underwater substructure having at least an upper cylindrical body and a lower cylindrical body for the gravity-type marine structure on the footing in the dry dock or a sea yard in a shallow sea area to easily stabilize the footing as a floating body, the upper cylindrical body of the underwater substructure having a bulkhead in the middle part to exert buoyance so as to function as a float, and each cylindrical body of the underwater substructure having a water through hole permitting the water communication between the inside and the outside of the cylindrical body;

towing the footing and the underwater substructure to an installing spot;

filling ballast water in the footing through the intake valve, which is at a standstill in a floating state at the installing spot, to submerge the footing;

then extending the lower cylindrical body of the underwater substructure with the submerge of the footing while the upper cylindrical body thereof functioning as the float; and landing the footing on the seabed.

2. A method of constructing a gravity-type marine structure in case of installing the gravity-type marine structure in a sea area with a comparatively great depth of water, comprising the steps of:

constructing a hollow footing for the gravity-type marine structure in a dry dock, the footing functioning as a float and having an intake valve capable of taking ballast water therethrough;

constructing a telescopic underwater substructure having at least an upper cylindrical body and a lower cylindrical body for the gravity-type marine structure on the footing in the dry dock or a sea yard in a shallow sea area to easily stabilize the footing as a floating body, the upper cylindrical body of the underwater substructure having a bulkhead in the middle part to function as a float, and each cylindrical body of the underwater substructure having a water through hole permitting the water communication between the inside and the outside of the cylindrical body;

towing the footing and the underwater substructure to an installing spot;

filling ballast water in the footing through the intake valve, which is at a standstill in a floating state at the installing spot, to submerge the footing;

extending the lower cylindrical body of the underwater substructure with the submerge of the footing while the upper cylindrical body thereof functioning as the float; and charging the footing or the underwater substructure with a filler, after the footing has landed on the seabed.

3. A method of constructing a gravity-type marine structure according to claim 2, wherein the underwater substructure is charged with the filler in the water.

4. A method of constructing a gravity-type marine structure according to claim 2, wherein after the footing has landed on the seabed, seawater is drained from the underwater substructure, and the underwater substructure is charged with the filler.

5. A gravity-type marine structure installed in a sea area with a comparatively great depth of water, comprising:

a hollow footing capable of exerting buoyancy to function as a float, the footing having an intake valve capable of taking ballast water therethrough; and an underwater substructure constructed on the footing and composed of a plurality of cylindrical bodies assembled in a telescopic form such that cylindrical bodies other than the lowermost cylindrical body fixed to the footing are made telescopic relatively to the lowermost cylindrical body;

wherein the upper cylindrical body of said underwater substructure serves as a float capable of exerting buoyancy by having a bulkhead in the middle part thereof, and each cylindrical body of the underwater substructure having a water through hole permitting the communication between the inside and the outside of the cylindrical body.

6. A gravity-type marine structure according to claim 5, wherein the footing is divided into a plurality of parts through inner partitions.

7. A gravity-type marine structure according to claim 5 or 6, wherein the connection part between the cylindrical bodies of the underwater substructure has hooks brought into engagement with each other.

8. A gravity-type marine structure according to claim 5 or 6, wherein the footing has a closable inlet enabling the charging of the filler.

9. A gravity-type marine structure according to claim 5 or 6, wherein the uppermost cylindrical body of the underwater substructure has a shaft enabling the charging of the filler.

10. A gravity-type marine structure according to claim 7, wherein water cutoff packings are able to be arranged between the hooks.

* * * * *